US010852669B2

(12) United States Patent
Goda et al.

(10) Patent No.: US 10,852,669 B2
(45) Date of Patent: Dec. 1, 2020

(54) IMAGE FORMING APPARATUS

(71) Applicant: FUJI XEROX CO., LTD., Tokyo (JP)

(72) Inventors: Toshihiro Goda, Kanagawa (JP); Yukihiro Ichiki, Kanagawa (JP); Akira Shimodaira, Kanagawa (JP); Keita Hashimoto, Kanagawa (JP); Masaki Suto, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/360,027

(22) Filed: Mar. 21, 2019

(65) Prior Publication Data

US 2020/0096912 A1 Mar. 26, 2020

(30) Foreign Application Priority Data

Sep. 21, 2018 (JP) ..... 2018-177629

(51) Int. Cl.
*G03G 15/16* (2006.01)
*G03G 21/20* (2006.01)

(52) U.S. Cl.
CPC ..... *G03G 15/1605* (2013.01); *G03G 21/206* (2013.01)

(58) Field of Classification Search
CPC .. G03G 21/206; G03G 21/1619; G03G 21/20; G03G 2221/1645; G03G 15/1605; G03G 15/2028
See application file for complete search history.

(56) References Cited

U.S. PATENT DOCUMENTS

| | | | | |
|---|---|---|---|---|
| 7,463,835 | B2 | 12/2008 | Harumoto | |
| 7,937,014 | B2 | 5/2011 | Kawamata | |
| 8,682,233 | B2 | 3/2014 | deJong et al. | |
| 8,918,039 | B2 | 12/2014 | Arikawa et al. | |
| 2012/0063790 | A1* | 3/2012 | Ogawa | B65H 7/00 399/16 |
| 2013/0108334 | A1* | 5/2013 | deJong | G03G 15/1615 399/312 |

(Continued)

FOREIGN PATENT DOCUMENTS

| | | |
|---|---|---|
| JP | 2007304192 | 11/2007 |
| JP | 2007310226 | 11/2007 |
| JP | 2014059391 | 4/2014 |

*Primary Examiner* — Walter L Lindsay, Jr.
*Assistant Examiner* — Jessica L Eley
(74) *Attorney, Agent, or Firm* — JCIPRNET

(57) ABSTRACT

An image forming apparatus includes: a transport path that transports an image forming medium in a top-bottom direction; a first image forming unit including a first intermediate transfer belt, which is disposed so as to face the transport path, to which toner images formed in multiple first toner-image forming units are transferred, and from which the toner images are transferred to the medium transported along the transport path; a second image forming unit including a second intermediate transfer belt, which is disposed upstream of the first image forming unit in a medium transport direction so as to face the transport path, to which toner images formed in multiple second toner-image forming units are transferred, and from which the toner images are transferred to the medium transported along the transport path; and a ventilation path formed between the first image forming unit and the second image forming unit, which are spaced apart.

17 Claims, 5 Drawing Sheets

(56) References Cited

U.S. PATENT DOCUMENTS

2015/0220053 A1* 8/2015 Yamauchi ..... G03G 15/238
399/94
2017/0315482 A1* 11/2017 Tsukamura ..... G03G 15/2039

* cited by examiner

IMAGE FORMING APPARATUS

CROSS-REFERENCE TO RELATED APPLICATIONS

This application is based on and claims priority under 35 USC 119 from Japanese Patent Application No. 2018-177629 filed Sep. 21, 2018.

BACKGROUND

(i) Technical Field

The present disclosure relates to an image forming apparatus.

(ii) Related Art

Japanese Unexamined Patent Application Publication No. 2007-304192 discloses an image forming apparatus including: a plurality of process cartridges that are arranged in parallel and are removably attached to an apparatus body; a transport belt that is disposed so as to face the process cartridges and transports a recording medium in the vertical direction; a cover body that is provided on the apparatus body in a manner capable of opening and closing, the cover body bringing the transport belt into a retractable state and exposing the process cartridge when opened; first determination members provided on the process cartridges, the first determination members having different shapes or being disposed at different positions to enable distinction between the colors of the process cartridges; second determination members that are provided on the apparatus body and indicate whether the process cartridges are located at proper setting positions by interfering or not interfering with the first determination members; and a transport-belt retract part that retracts the transport belt toward the cover body when the cover body is closed with a process cartridge being located at an improper setting position.

SUMMARY

Aspects of non-limiting embodiments of the present disclosure relate to an image forming apparatus in which airflows are easily created between image forming units, compared with an image forming apparatus having multiple image forming units that are provided next to each other so as to face a transport path, which transports, in the top-bottom direction, a medium on which an image is to be formed.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including: a transport path that transports an image forming medium in a top-bottom direction; a first image forming unit including a first intermediate transfer belt, which is disposed so as to face the transport path, to which toner images formed in a plurality of first toner-image forming units are transferred, and from which the toner images are transferred to the medium transported along the transport path; a second image forming unit including a second intermediate transfer belt, which is disposed upstream of the first image forming unit in a medium transport direction so as to face the transport path, to which toner images formed in a plurality of second toner-image forming units are transferred, and from which the toner images are transferred to the medium transported along the transport path; and a ventilation path formed between the first image forming unit and the second image forming unit, which are spaced apart.

BRIEF DESCRIPTION OF THE DRAWINGS

Exemplary embodiment of the present disclosure will be described in detail based on the following figures, wherein.

DETAILED DESCRIPTION

Exemplary Embodiment

Figure 1:
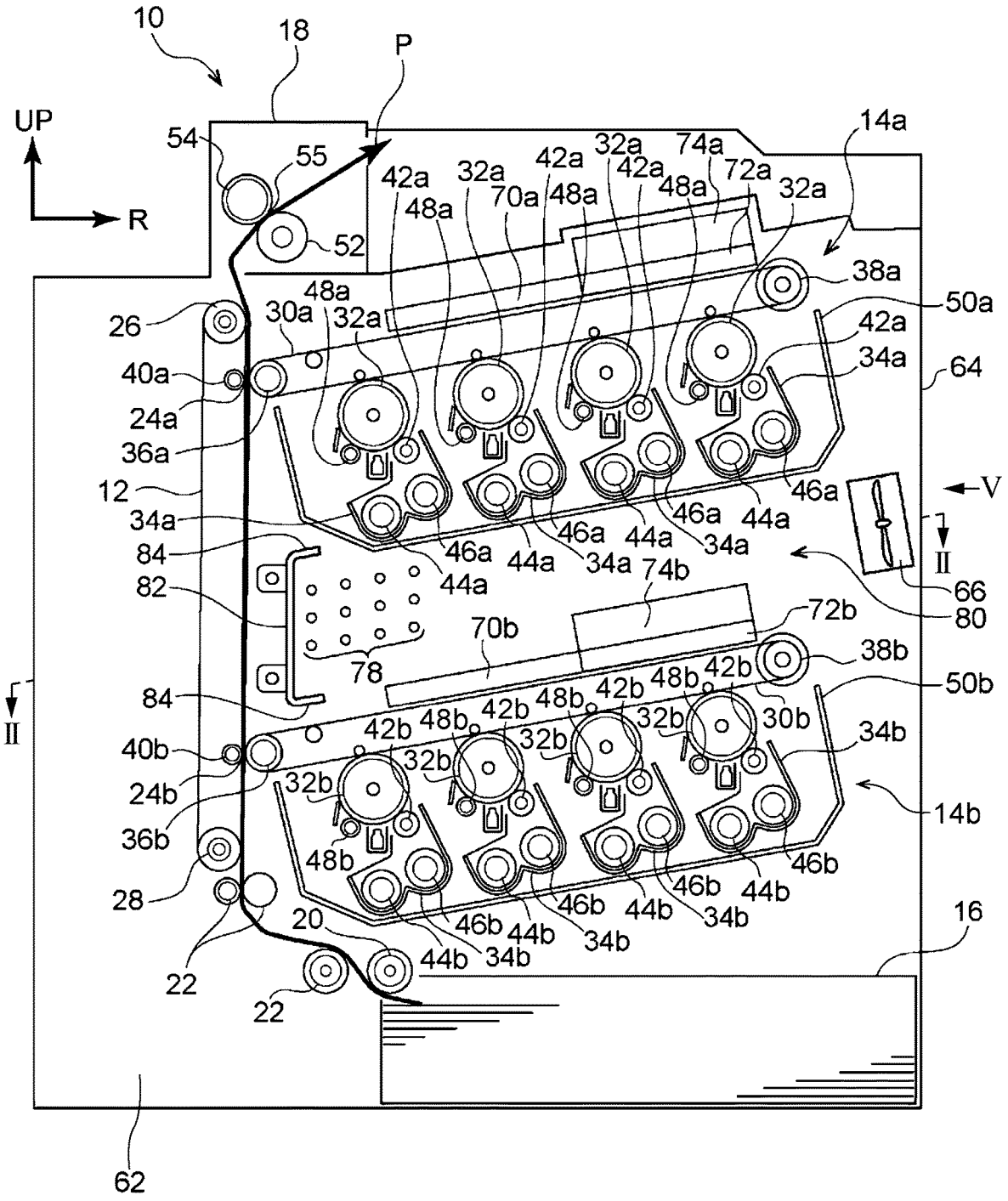
FIG. 1 is a front view showing the internal structure of an image forming apparatus according to an exemplary embodiment.
Figure 2:
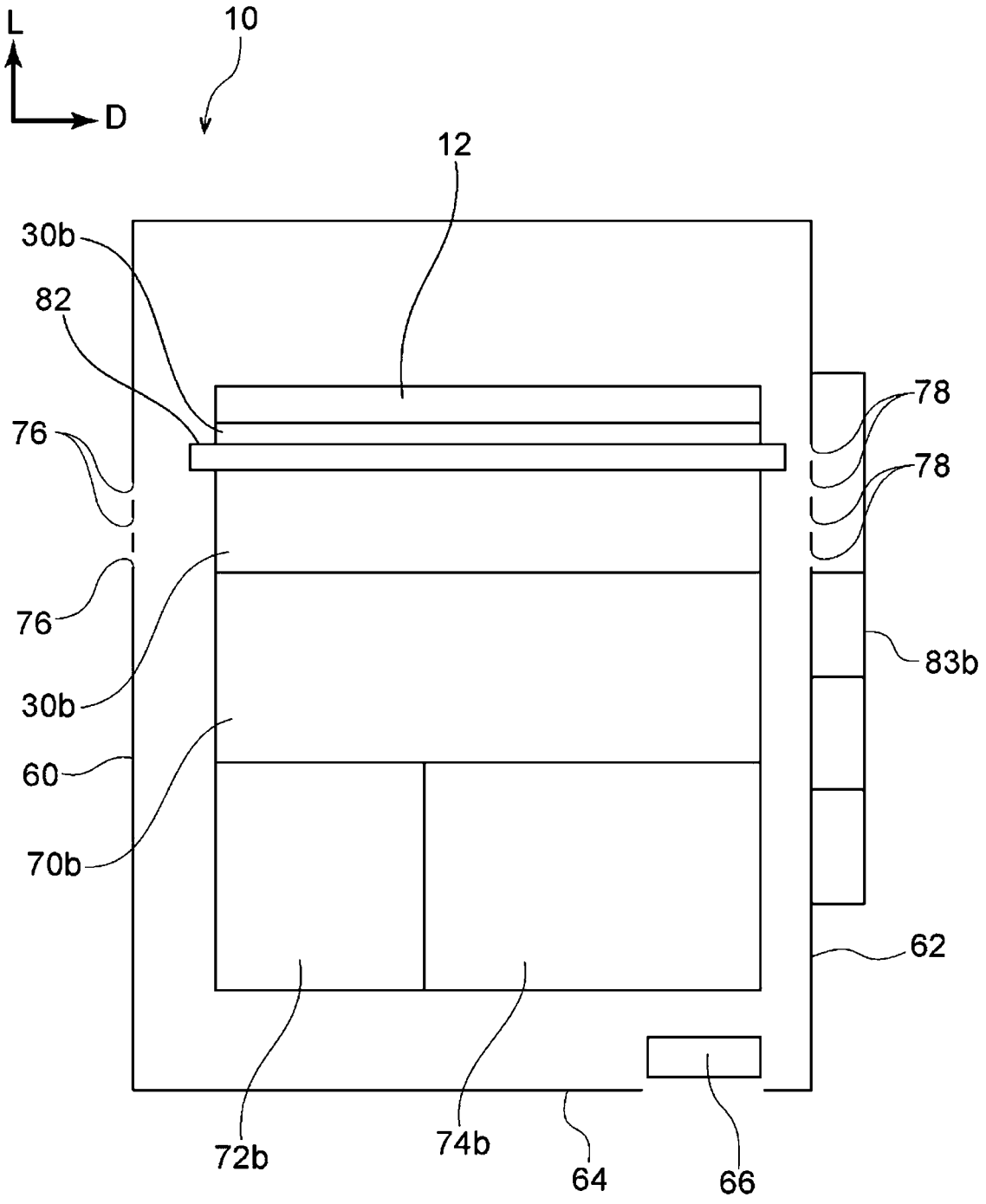
FIG. 2 is a sectional view taken along line II-II in FIG. 1.

Referring to FIGS. 1 to 5, an example of an image forming apparatus according to an exemplary embodiment of the present disclosure will be described. In the drawings, arrow UP points the upward direction, in the vertical direction, with respect to the apparatus. Furthermore, in FIGS. 1 and 2, arrow R points the right side, and arrow L points the left side in the horizontal direction for a user facing the front side of the apparatus. As shown in FIG. 2, arrow D points the far side, in the horizontal direction for a user facing the front side of the apparatus. In the description below, the term "top-bottom direction" means the top-bottom direction with respect to the apparatus in FIG. 1, unless otherwise specifically stated. Furthermore, in the description below, the term "left-right direction" means the left (L) and right (R) directions shown in FIG. 1 for a user facing the front side of the apparatus, unless otherwise specifically stated. Furthermore, in the description below, the term "depth direction (near and far)" means the depth direction shown in FIG. 2 for a user facing the front side of the apparatus.

Overall Configuration of Image Forming Apparatus

First, the configuration of the image forming apparatus 10 (also simply referred to as "the apparatus 10") will be described.

FIG. 1 shows the apparatus 10 with a near-side cover 60 (see FIG. 2) being removed to show the internal structure. As shown in FIG. 1, the image forming apparatus 10 includes: a transport belt 12, which comes into contact with the back surface of a sheet, serving as an example of a medium on which an image is formed, and transports the sheet along a sheet transport path P; an image forming unit 14*a* and an image forming unit 14*b*, which form images by using an electrophotographic system; a sheet tray 16 that accommodates sheets; and a fixing unit 18 that fixes the image to the sheet. The image forming units 14*a* and 14*b* are disposed so as to be spaced apart from each other.

The sheet accommodated in the sheet tray 16 is fed to the transport belt 12 by a feed roller 20, serving as an example of a sheet (medium) feeder. Transport rollers 22 provided along the transport path P transports sheet between the feed roller 20 and the transport belt 12.

The sheet fed by the transport belt 12 receives toner images formed by the image forming units 14*a* and 14*b*, which are disposed so as to face the transport belt 12, at transfer parts 24*a* and 24*b*. The image forming unit 14*a* and the transfer part 24*a* are disposed on the downstream side, and the image forming unit 14*b* and the transfer part 24*b* are disposed on the upstream side in the sheet transport direction.

The sheet to which the toner images have been transferred is transported from the transport belt 12 to the fixing unit 18. The toner image is then fixed to the sheet by the fixing unit 18. Subsequently, the sheet is output from the apparatus 10. Alternatively, the sheet is fed again to the transport belt 12 via a transport path (not shown).

Next, the configuration of the image forming apparatus 10 will be described on the basis of the locations of the respective components thereof.

As shown in FIG. 1, the sheet tray 16 is provided at the bottom of the image forming apparatus 10. The transport belt 12 is provided on the upper left side of the sheet tray 16 so as to extend along the sheet transport path P. The transport surface of the transport belt 12 extends in the top-bottom direction. Furthermore, multiple transport rollers 22 are provided between the feed roller 20 and the transport belt 12 along the sheet transport path P. With this configuration, the sheet fed from the sheet tray 16 by the feed roller 20 is transported leftward and then upward by the multiple transport rollers 22 and is then transported further upward by the transport belt 12.

The image forming units 14*a* and 14*b* are disposed so as to face the transport surface of the transport belt 12. The image forming units 14*a* and 14*b* are arranged one on top of the other with a certain space therebetween, in which the image forming unit 14*a* is disposed above the image forming unit 14*b*. Accordingly, the transfer part 24*a* formed by the image forming unit 14*a* and the transport belt 12 is located above the transfer part 24*b* formed by the image forming unit 14*b* and the transport belt 12.

The fixing unit 18 is provided above the transport belt 12. The sheet transported upward by the transport belt 12 is then directed in the lateral direction by transport rollers (not shown), passes through the fixing unit 18, and is output from the apparatus. Alternatively, the sheet transported upward by the transport belt 12 is fed again to the lower end of the transport surface of the transport belt 12 via a transport path (not shown).

Next, the configurations of the respective components of the image forming apparatus 10 will be described in detail.

Transport Belt

As shown in FIG. 1, the transport belt 12 runs between a roller 26 and a roller 28, which are disposed so as to be spaced apart from each other in the top-bottom direction. The roller 26, which is located on the upper side (i.e., on the downstream side in the sheet transport direction), also serves as a power-receiving part and is rotated by receiving a driving force from a driving source (not shown). The rotation of the roller 26 revolves the transport belt 12.

Image Forming Unit

As shown in FIG. 1, the image forming unit 14*a* located on the upper side and the image forming unit 14*b* located on the lower side basically have the same structure. Hence, in the description below, the image forming unit 14*a* will be described. Components belonging to or corresponding to the image forming unit 14*b* will be denoted by reference signs suffixed with "b", and the descriptions thereof will be omitted.

As shown in FIG. 1, the image forming unit 14*a* includes an intermediate transfer belt 30*a*, four photoconductors 32*a* (an example of toner-image carriers), developing units 34*a*, charging rollers 48*a*, driving sources for driving these components, and a housing 50*a* that accommodates, in a single unit, the aforementioned components.

Intermediate Transfer Belt

As shown in FIG. 1, the intermediate transfer belt 30*a* is an endless belt. The intermediate transfer belt 30*a* runs between a roller 36*a* and a roller 38*a*, which are disposed so as to be spaced apart from each other in the left-right direction. The roller 36*a* is disposed at the left end of the intermediate transfer belt 30*a* (i.e., on the downstream side in the toner-image transport direction), and the roller 38*a* is disposed at the right end of the intermediate transfer belt 30*a* (i.e., on the upstream side in the toner-image transport direction). Hence, the intermediate transfer belt 30*a* has an elongated shape extending in the left-right direction.

The roller 38*a* at the right end is located slightly above the roller 36*a* at the left end. Hence, the intermediate transfer belt 30*a* is slightly inclined such that the right end is higher. The roller 36*a* at the left end has a gear (not shown), which is a power-receiving part that receives the driving force from a driving source. The roller 38*a* at the right end applies tension to the intermediate transfer belt 30*a* to maintain the orientation of the belt.

Transfer Part

The left end of the intermediate transfer belt 30*a* is in contact with the transport belt 12. This part (the part at which the intermediate transfer belt 30*a* is in contact with the transport belt 12) is the transfer part 24*a*. A second transfer roller 40*a*, which applies a bias voltage for the second transfer, is disposed on the opposite side of the transport belt 12 from the roller 36*a*.

Photoconductor

Four roller-shaped photoconductors 32*a* are disposed below the intermediate transfer belt 30*a* so as to be in contact with the intermediate transfer belt 30*a*. The photoconductors 32*a* are arranged side-by-side in the left-right direction and are configured to rotate with the revolution of the intermediate transfer belt 30*a*. The photoconductors 32*a* are arranged such that the right end is higher, so as to conform to the inclination of the intermediate transfer belt 30*a*.

Developing Unit

The developing units 34*a* are disposed below the photoconductors 32*a*. Each developing unit 34*a* includes a developing roller 42*a* for developing a toner image on a photoconductor 32*a*, and two stirring rollers 44*a* and 46*a* for transporting and stirring developer containing the toner.

Charging Roller

The charging rollers 48*a*, which charge the surfaces of the photoconductors 32*a*, are disposed below the photoconductors 32*a* and to the left side of the developing units 34*a*. The charging rollers 48*a*, which are supplied with a voltage, rotate with the rotation of the photoconductors 32*a* while being in contact with the surfaces of the photoconductors 32*a*.

Substrate

As shown in FIG. 1, a control substrate 70*a* and a control substrate 72*a*, serving as an example of a controller that controls the operation of the image forming unit 14*a*, and a power-supply substrate 74*a*, serving as an example of a power supply circuit that supplies voltage to the image forming unit 14*a*, are provided above the intermediate transfer belt 30*a*. The control substrate 70*a* is disposed on the left side of the image forming unit 14*a*, and the control substrate 72*a* and the power-supply substrate 74*a* are disposed on the right side of the image forming unit 14*a*.

The control substrate 72*a* is disposed on the near side of the apparatus 10, and the power-supply substrate 74*a* is disposed on the far side of the apparatus 10.

The control substrate 70*a*, the control substrate 72*a*, and the power-supply substrate 74*a* are inclined such that the right ends are higher, so as to conform to the inclination of the intermediate transfer belt 30*a*.

The power-supply substrate 74*a* is an example of a power-supply substrate for a low-voltage supply (low voltage power supply: LV/LVPS).

Housing

The intermediate transfer belt 30*a*, the four photoconductors 32*a*, developing units 34*a*, charging rollers 48*a*, and driving source are held, in a single unit, by the housing 50*a*. The housing 50*a* can be attached to and removed from the body of the apparatus 10 while holding these components.

The lower side (bottom) of the housing 50*a* is inclined such that the right end is higher, so as to conform to the arrangement of the four photoconductors 32*a* and developing units 34*a*.

Driving Source

A driving source (not shown) having a driving gear (not shown) is provided on the near-side surface of the housing 50*a*. The gear is in mesh with power-receiving parts (driven gears: not shown) of the roller 36*a*, the photoconductors 32*a*, the charging rollers 48*a*, the developing rollers 42*a*, the stirring rollers 44*a*, and the stirring rollers 46*a* via multiple intermediate gears (not shown). This way, the rotational parts accommodated in the housing 50*a* receive the rotational driving force from one driving source. The rotation speeds of the rotational parts are controlled by the circumferential speed ratio of the intermediate gears.

Fixing Unit

As shown in FIG. 1, the fixing unit 18 includes a fixing roller 52, which also serves as a power-receiving part, and a roller-shaped fixing belt 54. More specifically, the power-receiving part has a gear (not shown) that is provided integrally with and coaxially with the fixing roller 52. The fixing roller 52 is disposed so as to come into contact with the surface of a transported sheet having a transferred toner image.

The fixing belt 54 is disposed opposite the fixing roller 52 with the sheet transport path P therebetween. The fixing roller 52 and the fixing belt 54 interfere with each other, forming a fixing nip 55. The fixing belt 54 rotates by being driven by the rotation of the fixing roller 52.

In this exemplary embodiment, the rotation speed of the fixing roller 52 in the fixing unit 18 is set slightly slower than the speed at which the transport belt 12 transports a sheet. Due to this difference in speed, the sheet transported between the transport belt 12 and the nip 55 is slackened. When the transported sheet is simultaneously nipped at the transfer part 24*a* and the nip 55, the slack in the sheet prevents the sheet from being pulled toward one of them.

Configuration of Relevant Part

Next, the configuration of the relevant part in this exemplary embodiment will be described.

Ventilation Path

As shown in FIG. 1, the apparatus 10 has a ventilation path 80 (an example of a path) between the image forming units 14*a* and 14*b*. More specifically, the path 80 is formed as an area (space) enclosed by a metal sheet 82 covering the left side, the image forming unit 14*a* covering the upper side, the image forming unit 14*b* covering the lower side, a cover 64 and a suction unit 66 (described in detail below) covering the right side, a cover 62 covering the far side, and the cover 60 covering the near side. Regarding the far side and the near side of the path 80, separately provided walls or the like may be provided on the inner side of the cover 60 and the cover 62. For example, inner walls, which are formed of frames or metal sheets (not shown), may be provided on the inner side of the cover 60 and the cover 62.

More specifically, the upper side of the path 80 is covered by the bottom surface of the housing 50*a* of the image forming unit 14*a*, and the lower side of the path 80 is covered by the intermediate transfer belt 30*b*, the control substrate 70*b*, the power-supply substrate 72*b*, and the power-supply substrate 74*b* of the image forming unit 14*b*.

Vent Hole

As shown in FIG. 2, the cover 60 provided on the near side of the path 80 has multiple vent holes 76, and the cover 62 provided on the far side of the path 80 has multiple vent holes 78.

Figure 3:
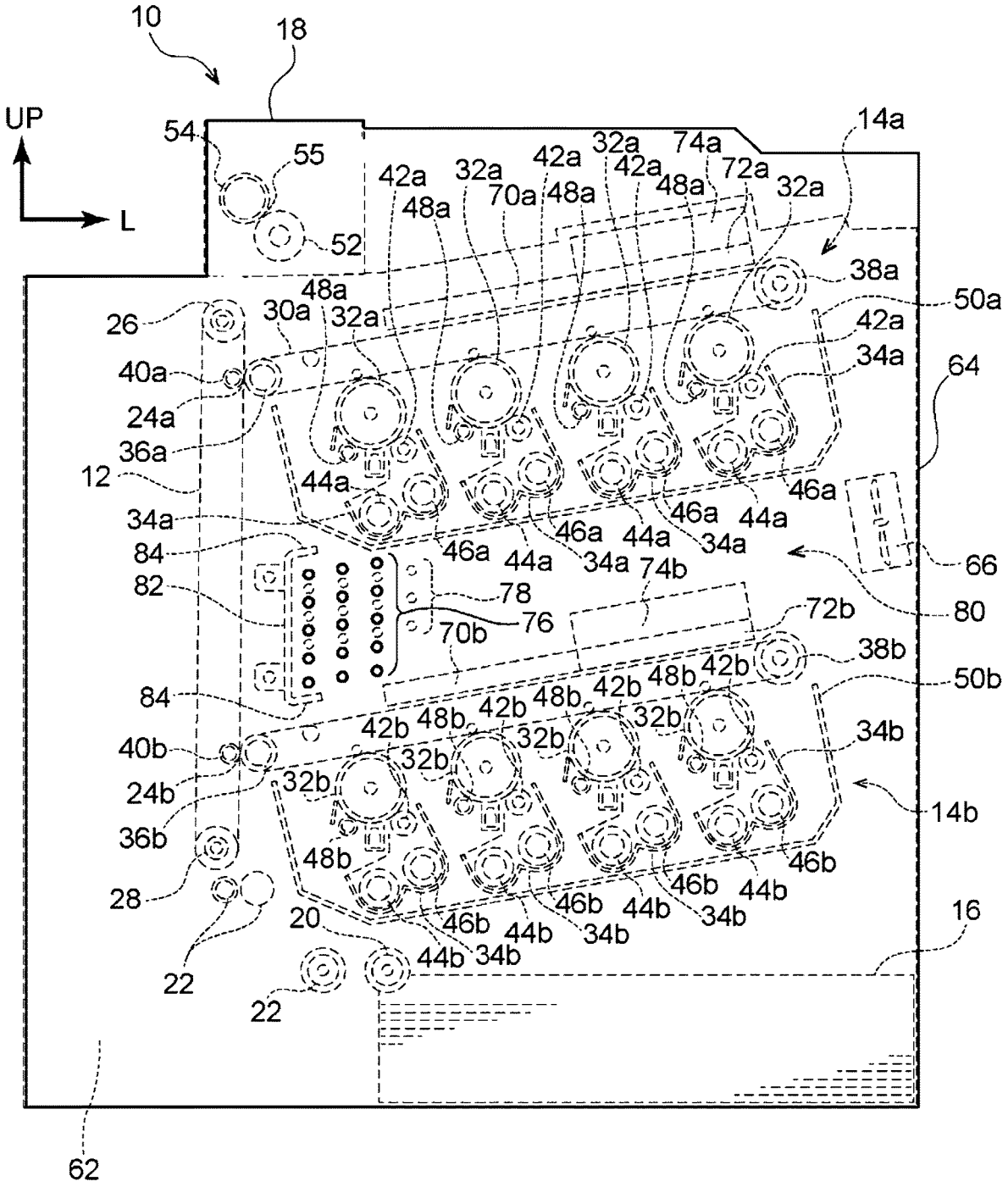
FIG. 3 is a front view of the image forming apparatus in FIG. 1.

As shown in FIG. 3, the vent holes 76 are provided in the cover 60 constituting the near-side surface of the ventilation path 80.

At least some of the vent holes 76 are located to the left of the developing unit 34*a* on the extreme left side (i.e., at a position closer to the transport belt 12) in the upper image forming unit 14*a*.

Furthermore, at least some of the vent holes 76 are located to the left of the control substrate 70*b*, the power-supply substrate 72*b*, and the power-supply substrate 74*b* in the lower image forming unit 14*b*.

As shown in FIG. 2, the vent holes 78 are provided in the cover 62 constituting the far-side surface of the ventilation path 80.

Figure 4:
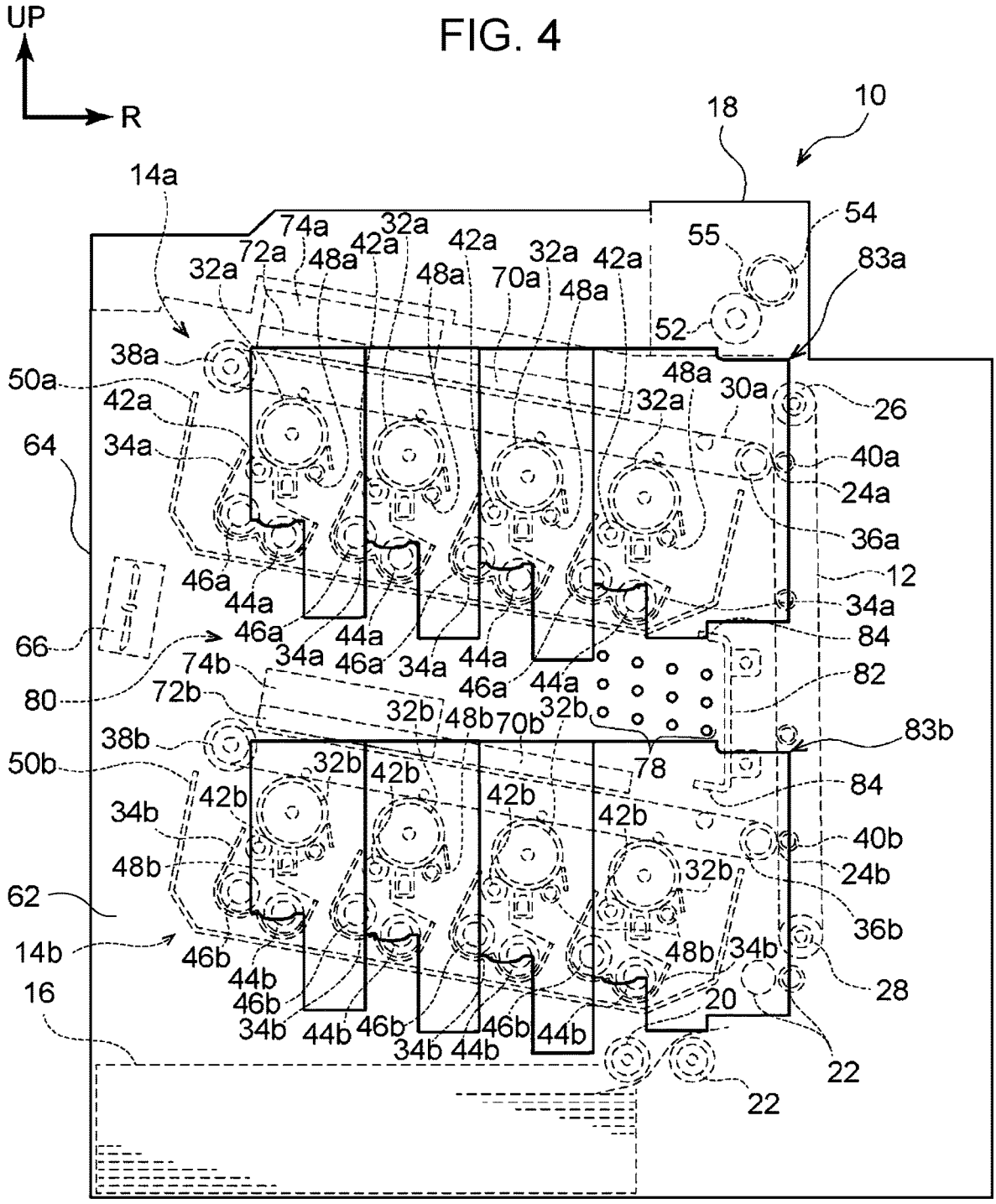
FIG. 4 is a back view of the image forming apparatus in FIG. 1.

As shown in FIG. 4, on the back-surface side of the cover 62, an upper toner cartridge 83*a* disposed at a position corresponding to the upper image forming unit 14*a*, and a lower toner cartridge 83*b* disposed at a position corresponding to the lower image forming unit 14*b* are provided. The vent holes 78 are provided so as to avoid these portions, in the cover 62, corresponding to the toner cartridge 83*a* and the toner cartridge 83*b*.

As shown in FIG. 3, on the near side of the apparatus 10, the vent holes 76 are distributed in a vertically long area, whereas, on the far side of the apparatus 10, the vent holes 78 are distributed in a horizontally long area so as to avoid the upper and lower toner cartridges 83*a* and 83*b*. The vent holes 76 are provided on the further left side (i.e., on the side closer to the transport belt 12) than the vent holes 78, which are provided so as to avoid the toner cartridges 83*a* and 83*b*.

Suction Unit

As shown in FIG. 1, the suction unit 66, which is an example of an airflow generating unit that generates an airflow and an example of an air discharging unit that discharges air, is disposed on the right side of the ventilation path 80. More specifically, the suction unit 66 is disposed on the opposite side of the upper intermediate transfer belt 30*a* and the lower intermediate transfer belt 30*b* from the transport belt 12, which constitutes the sheet transport path P.

As shown in FIG. 2, the suction unit 66 is disposed on the far side of the apparatus 10.

Herein, the suction unit 66 sucks the air in the path 80 in the direction from the transport surface of the transport belt 12 (left side) toward the outside of the apparatus 10 (i.e., to the right side), which is the direction away from the transport surface, and discharges the air. In this exemplary embodiment, the suction unit 66 is a centrifugal fan.

With this configuration, the air in the path is discharged from the apparatus 10 by the suction unit 66. As a result, the air outside the apparatus 10 is taken into the path through the vent holes 76 and 78.

More specifically, the outside air introduced from the vent holes 76 provided on the left near side of the apparatus 10 flows diagonally through the path 80 and is discharged from the apparatus 10 by the suction unit 66 provided on the right far side of the apparatus 10. The outside air introduced from the vent holes 78 provided in the left far side of the apparatus 10 flows from the left to the right on the far side of the path 80 and is discharged from the apparatus 10 by the suction unit 66 provided on the right far side of the apparatus 10.

Metal Sheet

As shown in FIG. 1, the metal sheet 82 (an example of a wall) that covers the transport belt 12, as viewed from the transport surface of the transport belt 12, is disposed on the left side of the ventilation path 80. The metal sheet 82 has a plate shape having a flat surface facing the transport surface of the transport belt 12. The metal sheet 82 is mounted to a frame (not shown) provided inside the apparatus 10.

The metal sheet 82 is disposed at a position closer to the transport belt 12 (i.e., the left side) than the vent holes 76, which are provided in the near-side cover 60 of the apparatus 10, and the vent holes 78, which are provided in the far-side cover 62 of the apparatus 10, are.

The vertical length of the metal sheet 82 is larger than those of the areas in which the vent holes 76 and 78 are provided. There are multiple vent holes 76 and 78. Hence, the upper end of the metal sheet 82 is located above the upper ends of the vent holes 76 and 78 that are provided on the extreme upper side, and the lower end of the metal sheet 82 is located below the lower ends of the vent holes 76 and 78 that are provided on the extreme lower side.

The metal sheet 82 has, at the upper and lower ends thereof, bent portions 84 extending in the lateral direction (i.e., the left-right direction of the apparatus 10). The bent portions 84 are formed by bending the upper and lower ends of the metal sheet 82.

The bent portions 84 formed at the upper and lower ends of the metal sheet 82 extend in the direction away from the transport surface of the transport belt 12. The ends (the right ends in FIG. 1) of the bent portions 84 are located to the right of the vent holes 76 and 78 that are located on the extreme left end. Specifically, the metal sheet 82 has a substantially U shape and covers, in front view of the apparatus 10, the left side, the left-side upper portion, and the left-side lower portion of the areas in the front cover 60 and the far-side cover 62 provided with the multiple vent holes 76 and 78.

Figure 5:
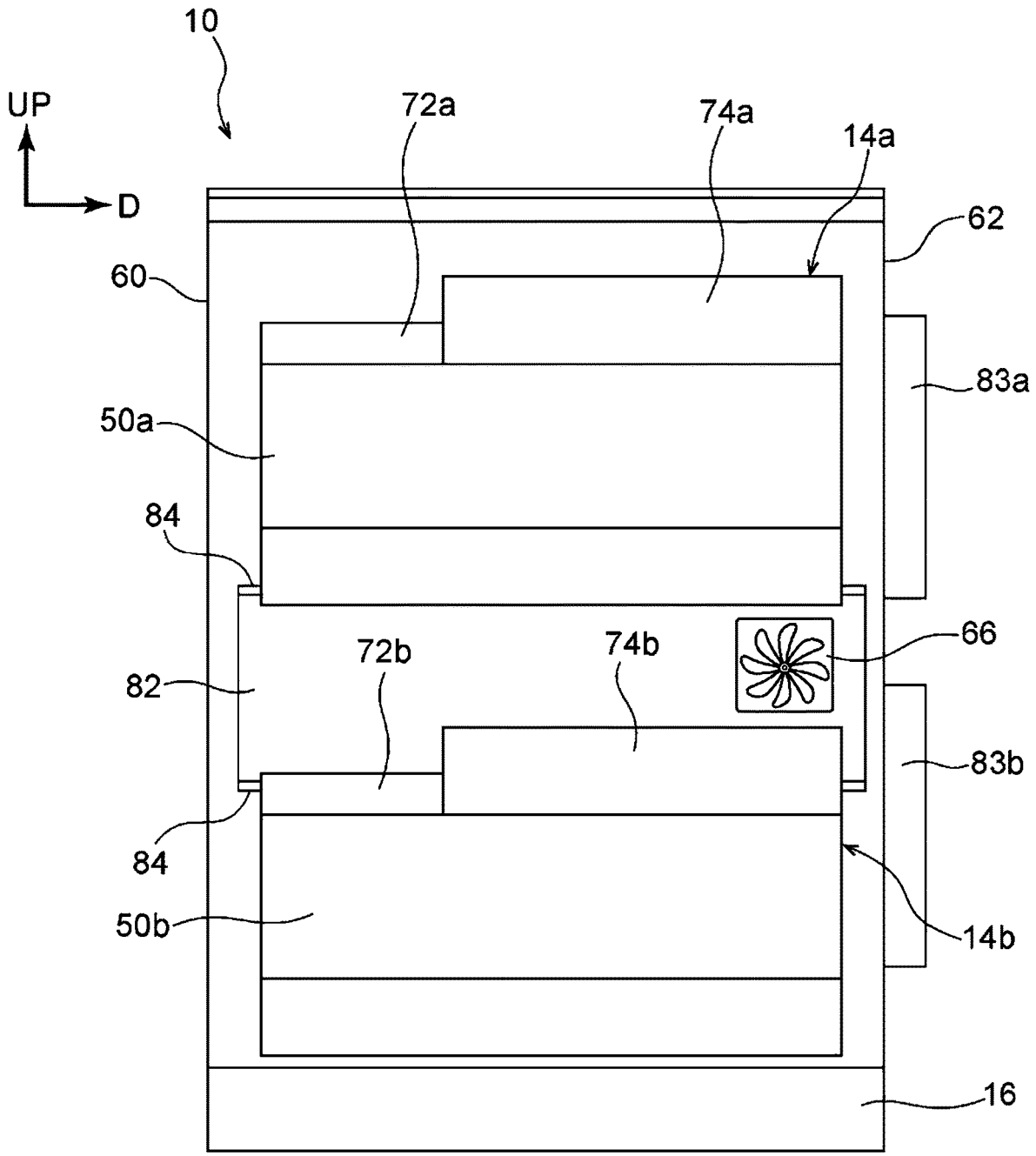
FIG. 5 is a side view of the image forming apparatus in FIG. 1, as viewed in the direction of arrow V in FIG. 1.

As shown in FIG. 5, when the path 80 is viewed in the direction V in FIG. 1 (i.e., from the right side of the apparatus 10, which is the direction parallel to the inclination of the housing 50*a* and the housing 50*b* as viewed from the suction unit 66), the transport belt 12 is behind the metal sheet 82 and cannot be viewed.

Effects

Next, the effects of this exemplary embodiment will be described.

As shown in FIG. 1, in this exemplary embodiment, the ventilation path is formed between the image forming unit 14*a*, which is located on the upper side, and the image forming unit 14*b*, which is located on the lower side. With this configuration, airflows are more easily generated between the image forming units, compared with a configuration in which the image forming units are disposed close to each other. Hence, the air heated by the heat released from the image forming units 14*a* and 14*b* is easily ventilated.

The path 80 is inclined such that a portion farther from the transport belt 12 is higher. Hence, the air heated by the heat released from the image forming units 14*a* and 14*b* ascends along the path. In this configuration, compared with a configuration in which the path 80 is inclined such that the portion farther from the transport belt 12 is lower, the heated air easily moves in the direction away from the transport belt 12. Hence, in this exemplary embodiment, the air in the path 80 is efficiently cooled.

In this exemplary embodiment, the intermediate transfer belts 30*a* and 30*b* are in contact with the transport belt 12 at the transfer parts 24*a* and 24*b*. Hence, the left side of the path 80 is enclosed by these components, and the air in the path 80 tends to stay therein. Hence, a configuration in which the air in the path 80 flows to the right side of the apparatus 10 (i.e., in the direction away from the transport belt 12), as shown in FIG. 1, is desirable.

Furthermore, in this exemplary embodiment, the air in the path 80 is flowed (i.e., an airflow is generated) by an airflow generating unit (i.e., the suction unit 66) that generates an airflow. In this configuration, an airflow is forced to be generated in the path 80, compared with a configuration in which the suction unit 66 is not provided.

The suction unit 66 is configured to suck (i.e., discharge) the air in the path 80 in the direction away from the transport surface of the transport belt 12. With this configuration, even though the left side of the path 80 is covered by the transport belt 12, it is possible to generate an airflow that moves the air in the path 80 in the direction away from the transport belt 12, compared with a configuration in which the air in the path 80 is sucked in the depth direction.

The control substrate 70*b* is provided above the lower image forming unit 14*b*, at a position away from the upper image forming unit 14*a*. With this configuration, airflows are efficiently generated around the control substrate 70*b*, compared with a configuration in which the control substrate 70*b* and the upper image forming unit 14*a* are close to each other. Hence, the air heated by the control substrate 70*b* is efficiently ventilated.

The power-supply substrate 74*b* is provided above the lower image forming unit 14*b*, to the right of the control substrate 70*b*, at a position away from the upper image forming unit 14*a*. With this configuration, airflows are efficiently generated around the power-supply substrate 74*b*, compared with a configuration in which the power-supply substrate 74*b* and the upper image forming unit 14*a* are close to each other.

With this configuration, it is possible to more efficiently ventilate higher-temperature air with the suction unit 66, compared with a configuration in which the power-supply substrate 74*b*, which generates more heat than the control substrate 70*b*, is disposed on the left side.

The power-supply substrate 74*b* is disposed on the far side of the apparatus 10 (i.e., at a position close to the suction unit 66). With this configuration, it is possible to more efficiently ventilate higher-temperature air, compared with the configuration in which the power-supply substrate 74*b* is disposed on the near side.

The vent holes 76 and 78, through which the outside air pass, are provided in the path 80, at the sides of the sheet transport path P. With this configuration, the outside air is more efficiently taken into the path 80, compared with a configuration without the vent holes 76 and 78.

Because both the near-side vent holes 76 and the far-side vent holes 78 are provided in the path 80, the outside air is more efficiently taken into the path 80, compared with a configuration in which one of the vent holes 76 and 78 are provided.

The near-side vent holes 76 and the far-side vent holes 78 in the path 80 are located closer to the transport belt 12 than the developing unit 34*a* on the extreme left side in the upper image forming unit 14*a* is. With this configuration, compared with the configuration in which the vent holes 76 and 78 are located farther from the transport belt 12 than the developing unit 34*a* is (i.e., to the right of the developing unit 34*a*), airflows are efficiently generated around the developing unit 34*a*.

The toner cartridges 83*a* and 83*b*, from which toner is supplied to the image forming unit 14*a* and 14*b*, are provided on the far-side wall of the apparatus 10. Hence, there is a limited area for the vent holes 78 in the far-side cover 62 of the apparatus 10. Accordingly, the number of the vent holes 78 are smaller than the number of vent holes 76 on the near side. Thus, more outside air can enter through the near-side vent holes 76 than the far-side vent holes 78.

Because the suction unit 66 is provided on the far side, the outside air (air) entering through the near-side vent holes 76 flows diagonally from the left near side toward the right far side in the path 80. Hence, more outside air (air) flows along a long path in the path 80, that is, the interior of the path 80 is more efficiently ventilated, compared with a configuration in which the suction unit 66 is provided on the near side.

The metal sheet 82 is disposed so as to cover the transport surface of the transport belt 12. In the configuration in this exemplary embodiment, the sheet is vertically transported on the transport belt 12, along the transport path P. At this time, the sheet is electrostatically attracted to the transport belt 12. In this state, the sheet is more likely to come off the transport path P during transportation, compared with a configuration in which the sheet is transported horizontally.

Moreover, in this configuration, the air in the path 80 is sucked by the suction unit 66 in the direction away from the transport belt 12. Hence, the sheet is more likely to come off the transport path P during transportation, due to the airflow.

In the configuration of the present disclosure, the metal sheet 82 covers the transport path P. This configuration suppresses the influence of the airflow on the medium, compared with a configuration in which a wall is provided so as to avoid a medium being transported.

Furthermore, the metal sheet 82 is disposed to the left of the vent holes 76 and 78. With this configuration, the flow of the outside air (air) entering through the vent holes 76 and 78 is more easily guided toward the right side, compared with a configuration in which the metal sheet is disposed to the right of the vent holes 76 and 78.

The metal sheet 82 has the bent portions 84 extending toward the right side. With this configuration, the flow of the outside air (air) entering through the vent holes 76 and 78 is more easily guided toward the right side, compared with a configuration in which the bent portions 84 extend toward the left side.

The vertical length of the metal sheet 82 is larger than the distance between the extreme upper vent holes 76 and 78 and the extreme lower vent holes 76 and 78. With this configuration, the outside air (air) entering through the vent holes 76 and 78 is more easily guided toward the right side, compared with the configuration in which the vertical length of the metal sheet 82 is smaller than the distance between the extreme upper vent holes 76 and 78 and the extreme lower vent holes 76 and 78.

Other Aspects

Although the image forming apparatus according to this exemplary embodiment has been described above, the image forming apparatus may of course be implemented in various forms within the scope not departing from the spirit of the present disclosure. For example, although it has been described that the image forming units 14*a* and 14*b* include four photoconductors 32*a* and 32*b*, four developing units 34*a* and 34*b*, and four charging rollers 48*a* and 48*b*, respectively, the number of these components may be either larger or smaller than four, as long as it is more than one.

Although it has been described that, in the image forming units 14*a* and 14*b*, the photoconductors 32*a* and 32*b* are disposed below the intermediate transfer belts 30*a* and 30*b*, respectively, the positional relationship may be reversed. Although it has been described that the intermediate transfer belts 30*a* and 30*b* are respectively stretched between the rollers 36*a* and 38*a* and the rollers 36*b* and 38*b* that are disposed so as to be spaced apart from each other in the left-right direction, the number of the rollers may be increased. In such a case, because each intermediate transfer belt is stretched around multiple rollers, the belt is maintained in, for example, a substantially triangular or rectangular orientation.

In this exemplary embodiment, the upstream side of the sheet transport path P is located on the lower side of the apparatus 10, and the downstream side of the sheet transport path P is located on the upper side of the apparatus 10. Hence, the sheet is transported from the lower side to the upper side of the apparatus 10. However, the arrangement of the sheet transport path P is not limited thereto, and, for example, the upstream side and the downstream side of the transport path P may be located on the same level. In such as case, for example, the upstream side of the transport path P may be disposed on the left side of the apparatus 10, and the downstream side of the transport path P may be disposed on the right side. With this configuration, the image forming unit 14*a* on the upstream side and the image forming unit 14*b* on the downstream side may be arranged at the same level along the sheet transport path P.

Alternatively, the upstream side and the downstream side of the sheet transport path P may be reversed in the top-bottom direction. In such a case, the sheet tray 16 is provided at the upper end of the apparatus 10. The image forming unit 14*b* on the upstream side is disposed above the lower image forming unit 14*a*. The fixing unit 18 is disposed at the lower end of the apparatus 10.

In addition, another image forming unit may be disposed between the image forming unit 14*a* on the downstream side and the image forming unit 14*b* on the upstream side. At this time, paths 80, suction units 66, vent holes 76 and 78, and metal sheets 82 may be provided between the image forming units.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

a transport path that transports an image forming medium from a tray in a top-bottom direction;

a first image framing unit including a first intermediate transfer belt, which is disposed so as to face the transport path, to which toner images formed in a plurality of first toner-image forming units are transferred, and from which the toner images are transferred to the medium transported along the transport path;

a second image forming unit including a second intermediate transfer belt, which is disposed upstream of the first image forming unit in a medium transport direction so as to face the transport path, to which toner images formed in a plurality of second toner-image forming units are transferred, and from which the toner images are transferred to the medium transported along the transport path;

a single transport belt, wherein the medium is transported from the tray to the first image forming unit and the second image forming unit along the transport path through the single transport belt; and a ventilation path formed between the first image forming unit and the second image forming unit, which are spaced apart.

2. The image forming apparatus according to claim 1, wherein an end of the first image forming unit adjacent to the second image forming unit and an end of the second image forming unit adjacent to the first image forming unit are inclined such that portions farther from the transport path are higher.

3. The image forming apparatus according to claim 1, further comprising:

a second transfer part at which the toner images are transferred from the second image forming unit to the medium; and a first transfer part at which the toner images are transferred from the first image forming unit to the medium, wherein the single transport belt that transports, between the second transfer part and the first transfer part, the medium along the transport path while being in contact with a back surface of the medium.

4. The image forming apparatus according to claim 1, further comprising an airflow generating unit that generates an airflow in the path.

5. The image forming apparatus according to claim 4, wherein the second image forming unit includes, on a side closer to the first intermediate transfer belt, a controller that controls the second toner-image forming units disposed so as to be spaced apart from the first intermediate transfer belt, and the airflow generating unit generates an airflow between, in the medium transport direction, the first intermediate transfer belt and the controller.

6. The image forming apparatus according to claim 4, wherein the second image forming unit includes, on a side closer to the first intermediate transfer belt, a power supply circuit that supplies power to the second toner-image forming units disposed so as to be spaced apart from the first intermediate transfer belt, and the airflow generating unit generates an airflow between, in the medium transport direction, the first intermediate transfer belt and the power supply circuit.

7. The image forming apparatus according to claim 4, wherein the airflow generating unit is an air discharging unit that discharges air in the path to outside of the path.

8. The image forming apparatus according to claim 7, wherein the airflow generating unit is a suction unit that sucks the air in the path in a direction away from the transport surface of the transport path, which transports the medium.

9. The image forming apparatus according to claim 7, wherein the airflow generating unit is disposed on an opposite side of the first intermediate transfer belt and the second intermediate transfer belt from the transport path.

10. The image forming apparatus according to claim 7, wherein vent holes through which outside air passes are provided on a side of the path in the medium transport direction.

11. The image forming apparatus according to claim 10, wherein the vent holes are provided on both sides in the medium transport direction.

12. The image forming apparatus according to claim 10, wherein the first image forming unit includes developing units that supply developer for forming images, and the vent holes are provided at a position closer to the transport path than the developing units are.

13. The image forming apparatus according to claim 10, wherein the first image forming unit and the second image forming unit have, on one side of the transport path, supply units that supply toner, the airflow generating unit is provided on the one side, and the vent holes are provided on the other side of the transport path.

14. The image forming apparatus according to claim 8, further comprising a wall that covers, as viewed from the suction unit, the medium passing between the first image forming unit and the second image forming unit in the transport path.

15. The image forming apparatus according to claim 14, wherein the wall has, at least one end in the medium transport direction, a bent portion extending toward the airflow generating unit.

16. The image forming apparatus according to claim 10, further comprising a wall that covers, as viewed from an opposite side of the path from the transport path, the medium passing between the first image forming unit and the second image forming unit in the transport path, the wall being located closer to the transport path than the vent holes are.

17. The image forming apparatus according to claim 16, wherein a length of the wall in the medium transport direction is larger than a length of an area in which the vent holes are provided.

* * * * *